US005925419A

United States Patent [19]

Kukisaki et al.

[11] Patent Number: 5,925,419

[45] Date of Patent: Jul. 20, 1999

[54] ELECTROSTATIC POWDER COATING METHOD FOR ROAD WHEELS

[75] Inventors: Koji Kukisaki, Kanagawa; Katsutoshi Kozoe, Chiba; Teruyuki Yamaguchi; Ryouji Shimizu, both of Tochigi, all of Japan

[73] Assignees: Nihon Parkerizing Co., Ltd., Tokyo; Nissan Motor Co., Ltd., Yokohama, both of Japan

[21] Appl. No.: 08/982,409

[22] Filed: Dec. 2, 1997

[30] Foreign Application Priority Data

Dec. 5, 1996 [JP] Japan ..... 8-325505

[51] Int. Cl.[6] ..... B05D 1/06; B05D 3/12; B05D 7/22

[52] U.S. Cl. ..... 427/475; 427/486; 427/348; 427/350; 427/372.2

[58] Field of Search ..... 427/181, 195, 427/235, 238, 294, 295, 348, 350, 470, 475, 485, 486, 271, 282, 372.2, 96; 301/37.1; 118/56, 504; 134/21, 22 R

[56] References Cited

U.S. PATENT DOCUMENTS 4,865,881 9/1989 Sessa et al. ..... 427/181

5,080,929 1/1992 Zachman et al. ..... 427/97

*Primary Examiner*—Frederick Parker

*Attorney, Agent, or Firm*—Wenderoth, Lind & Ponack, L.L.P.

[57] ABSTRACT

In an electrostatic powder coating method of the present invention, a wheel is placed on a supporting jig and powder is electrostatically applied on the surface of the wheel. Unnecessary powder adhered on a tapered surface of a bolt hole is eliminated by suctioning the air inside the bolt hole through a suction opening of the supporting jig. Thereby, a coating film can be formed on the road wheel without applying a coating on the tapered surface of the bolt hole.

7 Claims, 6 Drawing Sheets

ELECTROSTATIC POWDER COATING METHOD FOR ROAD WHEELS

BACKGROUND OF THE INVENTION

1. Field of the Invention

The present invention relates to an electrostatic powder coating method for a road wheel, in particular, to a method for masking the inside of a bolt hole of a hub bolt.

2. Description of the Related Art

A road wheel used in an automobile is made from steel or aluminum and generally has applied thereto a surface coating for improving weather resistance and corrosion resistance. As a surface coating method, there has been employed an electrostatic powder coating method where a powder is applied on a substance to be coated by utilizing static electricity since such a method can provide a higher quality coating without the risk of polluting the environment compared with a conventional method of using an organic solvent.

As shown in FIGS. 7 and 8, a wheel for an automobile has a plurality of bolt holes 2 arranged on the same circumference around a center hole 1. As shown in FIG. 9, the wheel can be attached on an axle hub of an automobile (not illustrated) by inserting a hub bolt 3 protruding from the axle hub into a bolt hole 2 from the rear side of the wheel and screwing a hub nut 4 on the hub bolt 3 from the front side of the wheel. At this time, a tapered surface 5 formed inside the bolt hole 2 of the wheel contacts with a tapered surface 6 of the hub nut 4, thereby the axes of the bolt hole 2 and the hub bolt 3 can be aligned.

Therefore, for the accurate alignment of the bolt hole 2 and the hub bolt 3, masking is required during coating so as not to form a coating film 7 on the tapered surface 5 in the bolt hole 2.

A conventional coating method using such a masking technique is shown in FIGS. 10A to 10D. As shown in FIG. 10A, a wheel is placed on a supporting jig 8 and a disk-like mask 9 is inserted in a bolt hole 2 from the front side of the wheel so as to close the upper part of the tapered surface 5. In this state, as shown in FIG. 10B, a powder 11 is applied on the surface of the wheel with a coating machine 10. At this time, the powder 11 is accumulated also on the mask 9 as well. A baking treatment is then applied after eliminating the powder 11 accumulated above the tapered surface 5 by lifting away with the mask 9 as shown in FIG. 10C. The mask 9 taken out from the bolt hole 2 is air-blown by using an air nozzle 12, as shown in FIG. 10D, to remove the powder 11 for the next coating operation.

Another conventional coating method is shown in FIGS. 11A to 11C. As shown in FIG. 11A, a wheel is placed on a supporting jig 8. In this state, as shown in FIG. 11B, a powder 11 is applied on the surface of the wheel with a coating machine 10. Since the tapered surface 5 in the bolt hole 2 is not masked, the powder 11 is accumulated unnecessarily on the tapered surface 5. As shown in FIG. 11C, a suction nozzle 13 is then inserted into the bolt hole 2 from the front side of the wheel, that is, from above to eliminate the unnecessary powder 11 accumulated on the tapered surface 5 through the suction nozzle 13 by vacuuming. A baking treatment is thereafter applied.

According to these conventional methods, the coating can be conducted without forming a coating film on the tapered surface 5. However, the method shown in FIGS. 10A to 10D involves the risk of fall-off of the powder 11 from the mask 9 at the time of lifting the mask 9. The method shown in FIGS. 11A to 11C involves the risk of fall-off of the suctioned powder 11 from the tip of the suction nozzle 13 since the unnecessary powder 11 is removed by the suction nozzle 13 inserted into the bolt hole 2 from above the wheel. The fall-off of the powder 11 from the mask 9 or the suction nozzle 13 onto the tapered surface 5 results in an unnecessary coating film formation, or the fall-off onto another part of the wheel results in deterioration of the coating quality of the part. Further, since the powder 11 is applied or eliminated for the unnecessary portion in a state that the wheel is placed on the planar supporting jig 8 so that the opening at the lower part of the bolt hole 2 is closed by the supporting jig 8, the powder 11 remains in the lower part of the bolt hole 2 so that there is a risk of adhesion of the powder 11 onto the inner wall of the bolt hole 2.

SUMMARY OF THE INVENTION

An object of the present invention is to provide an electrostatic powder coating method for a road wheel capable of forming a coating of a good quality on the surface of the road wheel without coating a tapered surface in a bolt hole for a hub bolt.

An electrostatic powder coating method for a road wheel of the present invention comprises the steps of electrostatically applying a powder to the road wheel from the front side thereof, and withdrawing air through the bolt hole from the rear side of the road wheel so as to eliminate unnecessary powder adhered on the inside of the bolt hole to the rear side.

In a case that the road wheel has a plurality of bolt holes arranged on a predetermined circumference, it is also possible to eliminate any unnecessary powder from the plurality of the bolt holes at the same time by a suction nozzle having a ring-shaped suction opening contacted with the rear side of the road wheel so as to cover all the bolt holes.

In a case that a bolt hole is provided with a tapered surface to be contacted with the hub nut inserted from the front side of the road wheel, powder unnecessarily adhered on the tapered surface can be withdrawn. Further, it is also possible to vacuum the air from the rear side of the road wheel with a bar-shaped auxiliary jig inserted in the bolt hole from the front side of the road wheel without contacting with the inner wall of the bolt hole so as to narrow the air flow path in the vicinity of the tapered surface. It is also possible to insert a blowing nozzle into the bolt hole from the front side of the road wheel without contacting with the inner wall of the bolt hole so that the air is blown from the blowing nozzle to the rear side of the road wheel at the same time the air is sucked from the rear side of the road wheel.

DESCRIPTION OF THE PREFERRED EMBODIMENTS

Hereinafter embodiments of the present invention will be described with reference to accompanied drawings.

First Embodiment

Figure 1A:
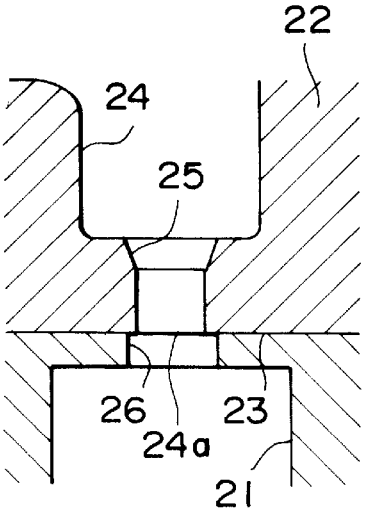
FIGS. 1A to 1C illustrate an electrostatic powder coating method according to a first embodiment of the present invention.
Figure 1B:
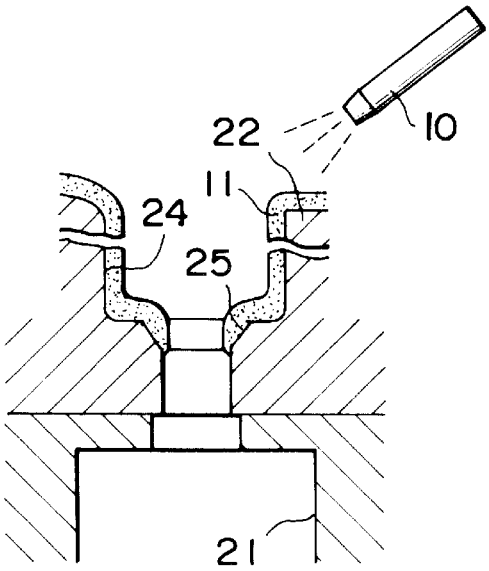
Figure 1C:
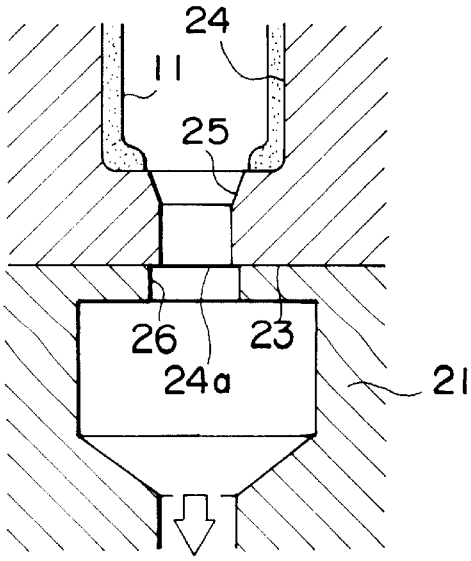

FIGS. 1A to 1C show a first embodiment of an electrostatic powder coating method of the present invention. As shown in FIG. 1A, an automobile wheel is first placed on a supporting jig 21. A bolt hole 24 is formed through the automobile wheel from the front side 22 to the rear side 23. A tapered surface 25 to be contacted with an unillustrated hub nut inserted from the front side 22 of the wheel is formed in the bolt hole 24. On the other hand, the supporting jig 21 has a suction opening 26 to be connected with the bolt hole 24 of the wheel, the suction opening 26 being connected with an unillustrated vacuum device. The suction opening 26 is formed larger than an opening 24*a* of the bolt hole 24 at the wheel rear side 23. The wheel and the supporting jig 21 are positioned such that the opening 24*a* is placed completely inside the suction opening 26.

In this state, as shown in FIG. 1B, a powder 11 is adhered on the front surface 22 of the wheel with a coating machine 10. The powder 11 adheres also to the inner wall of the bolt hole 24 so that the powder 11 is unnecessarily accumulated on the tapered surface 25 which should not be coated. After completing the coating of the powder 11, the air inside the bolt hole 24 is subjected to vaccuum with the unillustrated vacuum device through the suction opening 26. Accordingly, as shown in FIG. 1C, the unnecessarily accumulated powder 11 adhered on the tapered surface 25 of the bolt hole 24 is removed by being withdrawn through the opening 24*a* to the wheel rear side 23. The baking treatment is then applied on the accumulated powder 11 to form a coated film.

Since the unnecessary powder 11 adhered on the tapered surface 25 is eliminated through the opening 24*a* of the bolt hole 24 to the wheel rear side 23, there is no risk of fall-off of the powder 11 onto the wheel surface during the elimination operation so that deterioration of the quality of the coated film quality can be avoided.

A coating film of a multi-layer structure can also be realized with an excellent quality by successively forming a base coat layer and a top coat layer on an undercoat layer which is formed on the surface of the wheel made of steel or aluminum in the above-mentioned manner. In this case, the base coat layer may be formed by a coating method utilizing an organic solvent.

Second Embodiment

Figure 2:
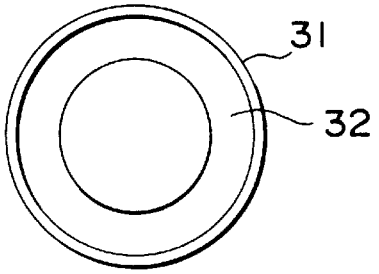
FIG. 2 is a plan view showing an air suction nozzle used in a second embodiment.
Figure 3:
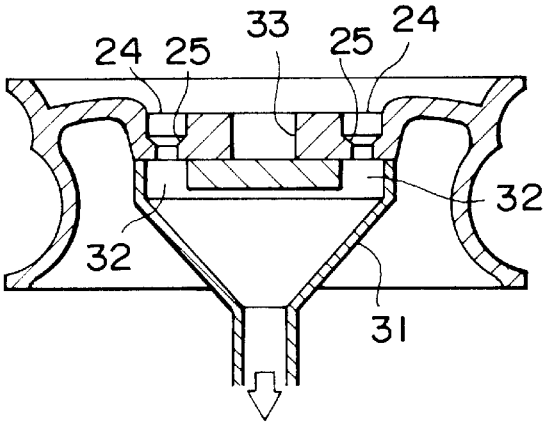
FIGS. 3 and 4 are a cross-sectional view and a plan view, respectively, showing the air suction nozzle of FIG. 2 contacted with the rear side of an automobile wheel.

FIG. 2 is a plan view of an air suction nozzle 31 used in a second embodiment. The air suction nozzle 31 has a ring-shaped suction opening 32 formed on the round upper surface thereof, which also serves as a supporting jig for supporting the automobile wheel at the time of coating. As shown in FIGS. 2 and 3, the wheel has a plurality of bolt holes 24 arranged on a circumference having a predetermined diameter D around the center hole 33. The inner diameter and the outer diameter of the suction opening 32 of the air suction nozzle 31 are set at a size such that the suction opening 32 can cover all the bolt holes 24 at the same time.

With this air suction nozzle 31, powder coating is conducted as in the first embodiment. That is, as shown in FIG. 3, the wheel is placed on the air suction nozzle 31 such that the opening of each bolt hole 24 is placed within the ring-like suction opening 32. In this state, a powder is adhered on the wheel surface with an unillustrated coating machine. The powder is adhered also to the inner walls of the bolt holes 24 so that powder is unnecessarily accumulated on a tapered surface 25 in each bolt hole 24, which should not be coated. After completing the coating of the powder, the air inside the bolt holes 24 is evacuated by the unillustrated vacuum device through the ring-like suction opening 32. Accordingly, the unnecessarily accumulated powder adhered on the tapered surface 25 of each bolt hole 24 is withdrawn at the wheel rear side at the same time. The baking treatment is then applied on the accumulated powder to form a coated film.

According to the second embodiment, since the air inside the bolt holes 24 can be withdrawn by the air suction nozzle 31 having a ring-like suction opening 32, the unnecessary powder in a plurality of bolt holes 24 can be eliminated at the same time. Furthermore, since the suction opening 32 is ring-like, the unnecessary powder can be eliminated easily regardless of the angular position of the bolt holes 24 of the wheel as long as the air suction nozzle 31 and the wheel are aligned. That is, the alignment of the individual bolt hole 24 and the air suction nozzle 31 is not required.

Figure 4:
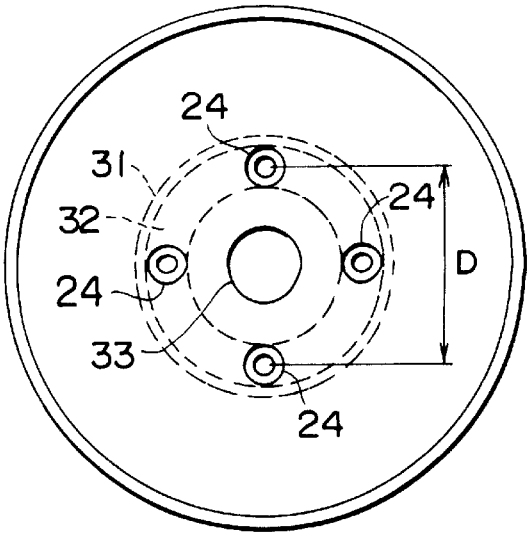

Although the automobile wheel shown in FIG. 4 has four bolt holes 24 arranged on a predetermined circumference, another wheel may have a different number of bolt holes 24, for example, five holes. Since the suction opening 32 of the air suction nozzle 31 is ring-like, the same air suction nozzle 31 can also be used for eliminating any unnecessary powder for such a wheel having a different number of the bolt holes 24. Furthermore, the diameter D of the circumference where a plurality of bolt holes 24 are arranged may slightly differ depending on the type of the automobile wheel. The same air suction nozzle 31 can be used for plural kinds of wheels having slightly different diameter D sizes by setting the width of the suction opening 32 of the air suction nozzle 31 wider. Accordingly, the air suction nozzle 31 of the second embodiment is extremely advantageous in realizing the automatic powder coating of a road wheel.

Third Embodiment

Figure 5:
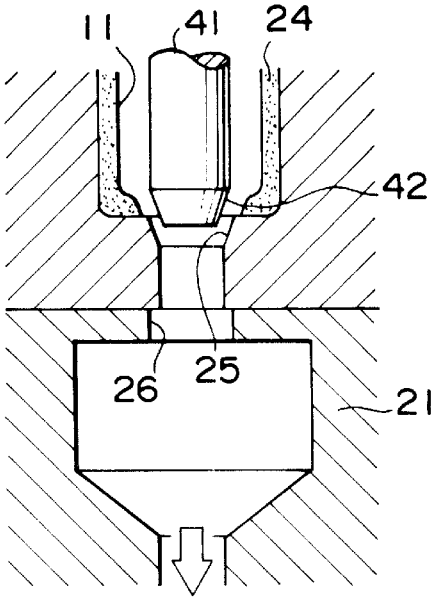
FIGS. 5 and 6 are cross-sectional views showing coating methods of third and fourth embodiments, respectively.

An electrostatic powder coating method according to a third embodiment will be described with reference to FIG. 5. This third embodiment differs from the first embodiment shown in FIGS. 1A to 1C in that the air in the bolt hole 24 is sucked from the suction opening 26 of the supporting jig 21 with a bar-shaped auxiliary jig 41 inserted into the bolt hole 24 from the front side of the wheel without contacting with the inner wall of the bolt hole 24 in eliminating the unnecessary powder 11 adhered on the tapered surface 25 of the bolt hole 24. A tapered portion 42 corresponding to the tapered surface 25 of the bolt hole 24 is formed at the tip portion of the auxiliary jig 41. The auxiliary jig 41 is inserted such that the tapered portion 42 thereof comes in the proximity of the tapered surface 25 of the bolt hole 24. Accordingly, the air flow path in the vicinity of the tapered surface 25 is narrowed to accelerate the flow rate of the suction air passing through the path so that the unnecessary powder 11 adhered on the tapered surface 25 can be efficiently withdrawn through the suction opening 26 of the supporting jig 21.

It is also possible to vacuum the inside of the bolt holes 24 with auxiliary jigs 41 inserted for each of the plurality of the bolt holes 24 from the wheel surface side in the electrostatic powder coating method of the second embodiment.

Fourth Embodiment

Figure 6:
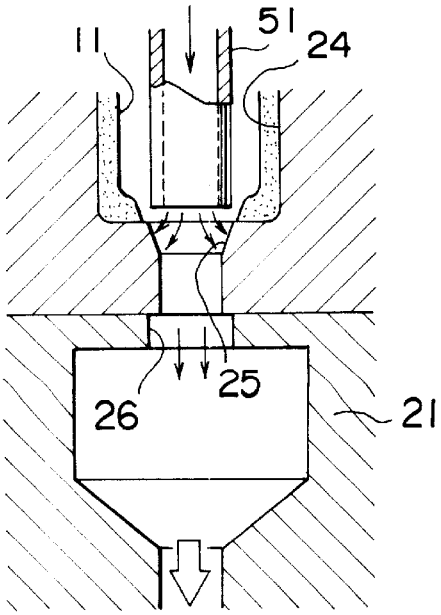
Figure 7:
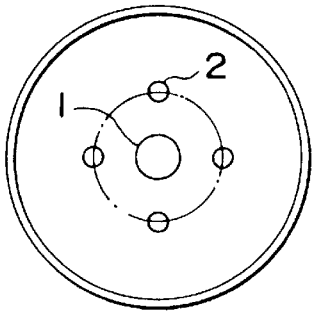
FIG. 7 PRIOR ART
FIGS. 7 and 8 are a plan view and a partially sectioned side view of an automobile wheel, respectively.
Figure 8:
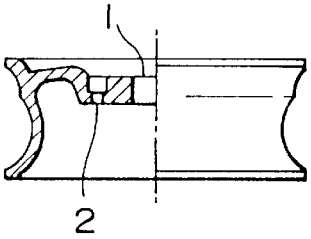
FIG. 8 PRIOR ART
Figure 9:
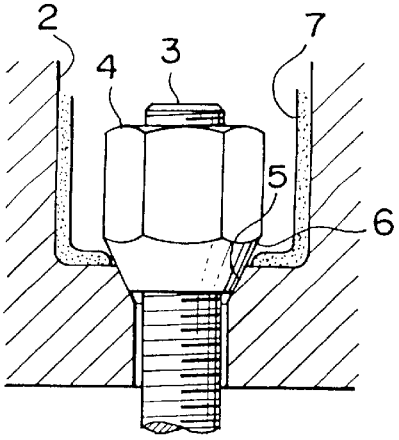
FIG. 9 PRIOR ART
FIG. 9 is an enlarged cross-sectional view showing the vicinity of a bolt hole of an automobile wheel.
Figure 10A:
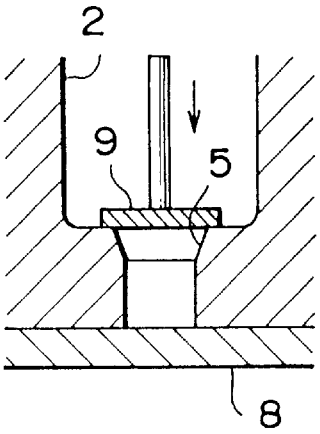
FIG. 10A PRIOR ART
FIGS. 10A to 10D illustrate a conventional coating method.
Figure 10B:
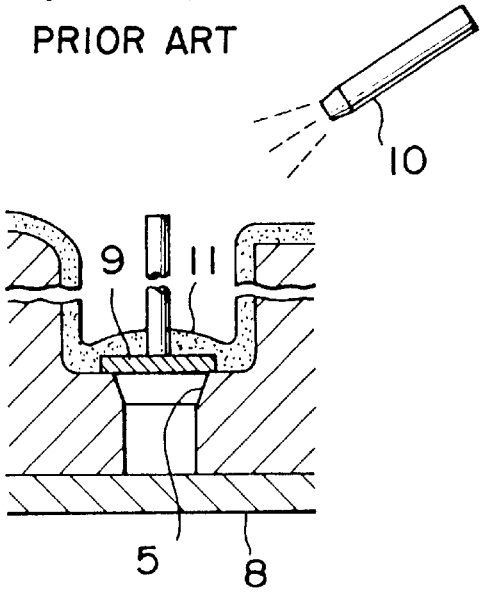
FIG. 10B PRIOR ART
Figure 10C:
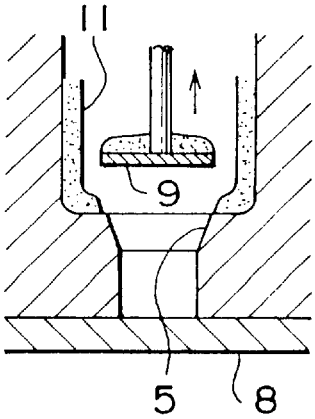
FIG. 10C PRIOR ART
Figure 10D:
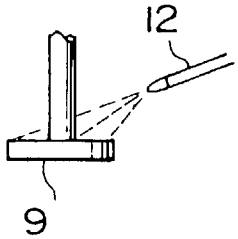
FIG. 10D PRIOR ART
Figure 11A:
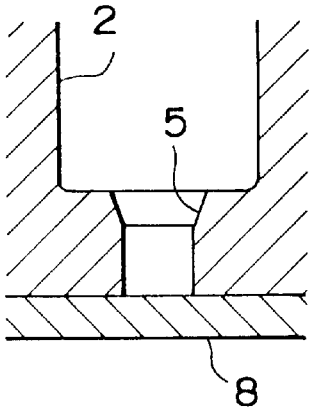
FIG. 11A PRIOR ART
FIGS. 11A to 11C illustrate another conventional coating method.
Figure 11B:
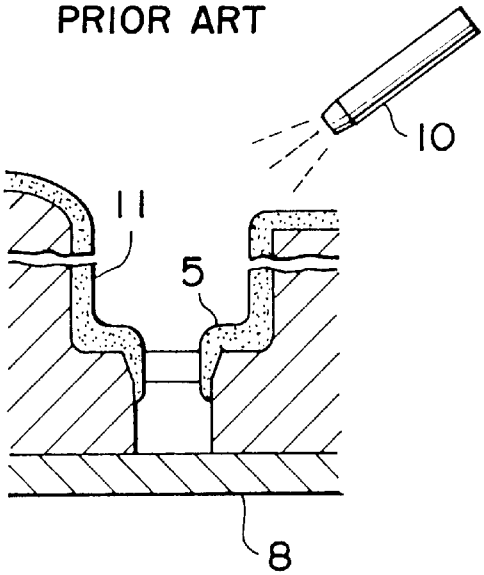
FIG. 11B PRIOR ART
Figure 11C:
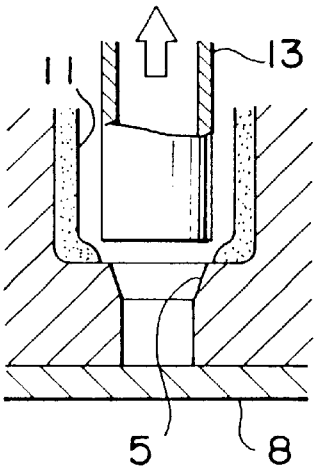
FIG. 11C PRIOR ART

An electrostatic powder coating method of a fourth embodiment will be described with reference to FIG. 6. This fourth embodiment differs from the first embodiment shown in FIG. 1 in that a blowing nozzle 51 is inserted into the bolt hole 24 from the front side of the wheel without contacting with the inner wall of the bolt hole 24 and the air is blown inside of the bolt hole 24 to the wheel rear side from the tip of the blowing nozzle 51, as well as the air in the bolt hole 24 being evacuated through from the suction opening 26 of the supporting jig 21 in eliminating the unnecessary powder 11 adhered on the tapered surface 25 of the bolt hole 24. The air blown from the blowing nozzle 51 is sucked through the suction opening 26 of the supporting jig 21 to eliminate the unnecessary powder 11 adhered on the tapered surface 25. The amount of the blown air from the blowing nozzle 51 is set corresponding to the amount of the vacuumed air from the suction opening 26 of the supporting jig 21. Therefore, the unnecessary powder 11 on the tapered surface 25 can be eliminated with a minimum influence of the air flow on the powder 11 attached on the inner wall of the wheel surface side with respect to the tapered surface 25 of the bolt hole 24.

It is also possible in the electrostatic powder coating method of the second embodiment to insert such a blowing nozzle 51 into each bolt hole 24 from the front side of the wheel to blow the air from the nozzles 51 as well as vacuum the inside of the bolt holes 24 from the ring-like suction opening 32.

Although coating of an automobile wheel has been discussed in the above-mentioned embodiments, the present invention is not limited thereto but it can be employed similarly in a powder coating of other kinds of road wheels while realizing the same effects.

As hereinbefore explained, according to the present invention, since an unnecessary powder attached on the tapered surface of a bolt hole for a hub bolt is withdrawn to the rear side of a road wheel, a coating of an excellent quality can be formed without the risk of fall-off of the powder on the surface of the road wheel during the elimination operation.

What is claimed is:

1. An electrostatic powder coating method for coating a wheel, said wheel having extending therethrough, from a front side thereof to a rear side thereof, a plurality of bolt holes for receiving hub bolts, said bolt holes being arranged on a circumference of said wheel and each said bolt hole having a tapered surface to be contacted by a hub nut to be inserted from said front side of said wheel, said method comprising:

electrostatically applying powder to said wheel from said front side thereof and thereby coating said front side, during which powder is adhered to said tapered surfaces of said bolt holes;

positioning a suction nozzle having a ring-shaped suction opening at said rear side of said wheel such that said suction opening simultaneously covers all of said bolt holes; and suctioning air simultaneously through all said bolt holes from said rear side of said wheel and through said suction nozzle and thereby simultaneously withdrawing said powder adhered to said tapered surfaces of said bolt holes from said rear side of said wheel and through said suction nozzle to eliminate the powder adhered to said tapered surfaces.

2. A method as claimed in claim 1, wherein said suction nozzle is positioned with a center of said suction opening coinciding with a center of said circumference of said wheel.

3. A method as claimed in claim 1, further comprising positioning an auxiliary jig into each said bolt hole from said front side of said wheel without contacting said jig with said tapered surface, thereby narrowing a path of air flow along said tapered surface.

4. A method as claimed in claim 3, wherein said jig has a tapered surface corresponding to said tapered surface of said bolt hole.

5. A method as claimed in claim 1, further comprising positioning a blowing nozzle into each said bolt hole from said front side of said wheel without contacting said blowing nozzle with said tapered surface, and blowing air from said blowing nozzle toward said rear side of said wheel at the same time as air is suctioned through said bolt holes from said rear side of said wheel.

6. A method as claimed in claim 1, further comprising, after said withdrawing of said powder, baking said powder remaining on said wheel and thus forming a coated wheel.

7. A method as claimed in claim 1, wherein said wheel comprises an automobile wheel.

* * * * *